US011788536B2

(12) United States Patent
Kuroda

(10) Patent No.: US 11,788,536 B2
(45) Date of Patent: Oct. 17, 2023

(54) CENTRIFUGAL COMPRESSOR

(71) Applicant: MITSUBISHI HEAVY INDUSTRIES COMPRESSOR CORPORATION, Tokyo (JP)

(72) Inventor: Miku Kuroda, Tokyo (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 0 days.

(21) Appl. No.: 17/655,259

(22) Filed: Mar. 17, 2022

(65) Prior Publication Data

US 2022/0381249 A1 Dec. 1, 2022

(30) Foreign Application Priority Data

May 31, 2021 (JP) ..... 2021-091727

(51) Int. Cl.
*F04D 29/28* (2006.01)
*F04D 17/10* (2006.01)
*F04D 29/44* (2006.01)

(52) U.S. Cl.
CPC ..... *F04D 17/10* (2013.01); *F04D 29/284* (2013.01); *F04D 29/444* (2013.01)

(58) Field of Classification Search
None
See application file for complete search history.

(56) References Cited

U.S. PATENT DOCUMENTS 4,543,036 A * 9/1985 Palmer ..... F04D 29/462 415/157
11,073,162 B2 * 7/2021 Hermes ..... F04D 29/444
2008/0014082 A1 * 1/2008 Kobayashi ..... F04D 29/2216 415/199.1
2013/0287542 A1 10/2013 Nichols et al.

FOREIGN PATENT DOCUMENTS

DE 2414110 A1 10/1975
FR 2133196 A5 11/1972
JP 2007-309154 A 11/2007

* cited by examiner

*Primary Examiner* — Michael Lebentritt
(74) *Attorney, Agent, or Firm* — Osha Bergman Watanabe & Burton LLP

(57) ABSTRACT

A centrifugal compressor includes: an impeller which is allowed to rotate around an axis; a casing in which the impeller is accommodated and a guide flow path guiding fluid to the impeller is formed; and a guide vane which is disposed in the guide flow path and is extended from a hub side wall surface of the guide flow path, which is continued to a hub side of the impeller, to a shroud side wall surface of the guide flow path to a shroud side of the impeller, wherein the guide vane is twisted forward the impeller in a rotating direction thereof as close to the shroud side wall surface from the hub side wall surface.

6 Claims, 4 Drawing Sheets

CENTRIFUGAL COMPRESSOR

FIELD OF THE INVENTION

The present disclosure relates to a centrifugal compressor. Priority is claimed on Japanese Patent Application No. 2021-91727, filed May 31, 2021, the content of which is incorporated herein by reference.

DESCRIPTION OF RELATED ART

A centrifugal compressor includes a rotating impeller, a casing forming a guide flow path guiding a fluid toward the impeller, and a plurality of guide vanes provided in the guide flow path (for example, Japanese Unexamined Patent Application, First Publication No. 2007-309154).

In a general centrifugal compressor, a swirling component is not added to a flow flowing into the impeller. That is, a fluid linearly flows into the impeller.

SUMMARY OF THE INVENTION

On the other hand, in recent years, the number of rotations of the impeller has been increasing. Therefore, the relative inflow velocity of the fluid with respect to the impeller has tended to increase. When the relative inflow velocity increases, a shock wave is likely to be generated between blades of the impeller and the choke limit flow rate becomes low (the operating range of the centrifugal compressor becomes narrow).

The present disclosure has been made to solve the above-described problems and an object thereof is to provide a centrifugal compressor having a further expanded operating range.

In order to solve the above-described problems, a centrifugal compressor according to the present disclosure includes: an impeller which is allowed to rotate around an axis; a casing in which the impeller is accommodated and a guide flow path guiding a fluid to the impeller is formed; and a guide vane which is disposed in the guide flow path and is extended from a hub side wall surface of the guide flow path, which is continued to a hub side of the impeller, to a shroud side wall surface of the guide flow path, which is continued to a shroud side of the impeller, wherein the guide vane is twisted forward the impeller in a rotating direction thereof as close to the shroud side wall surface from the hub side wall surface.

According to the present disclosure, it is possible to provide a centrifugal compressor having a further expanded operating range.

DETAILED DESCRIPTION OF THE INVENTION

Configuration of Centrifugal Compressor

Figure 1:
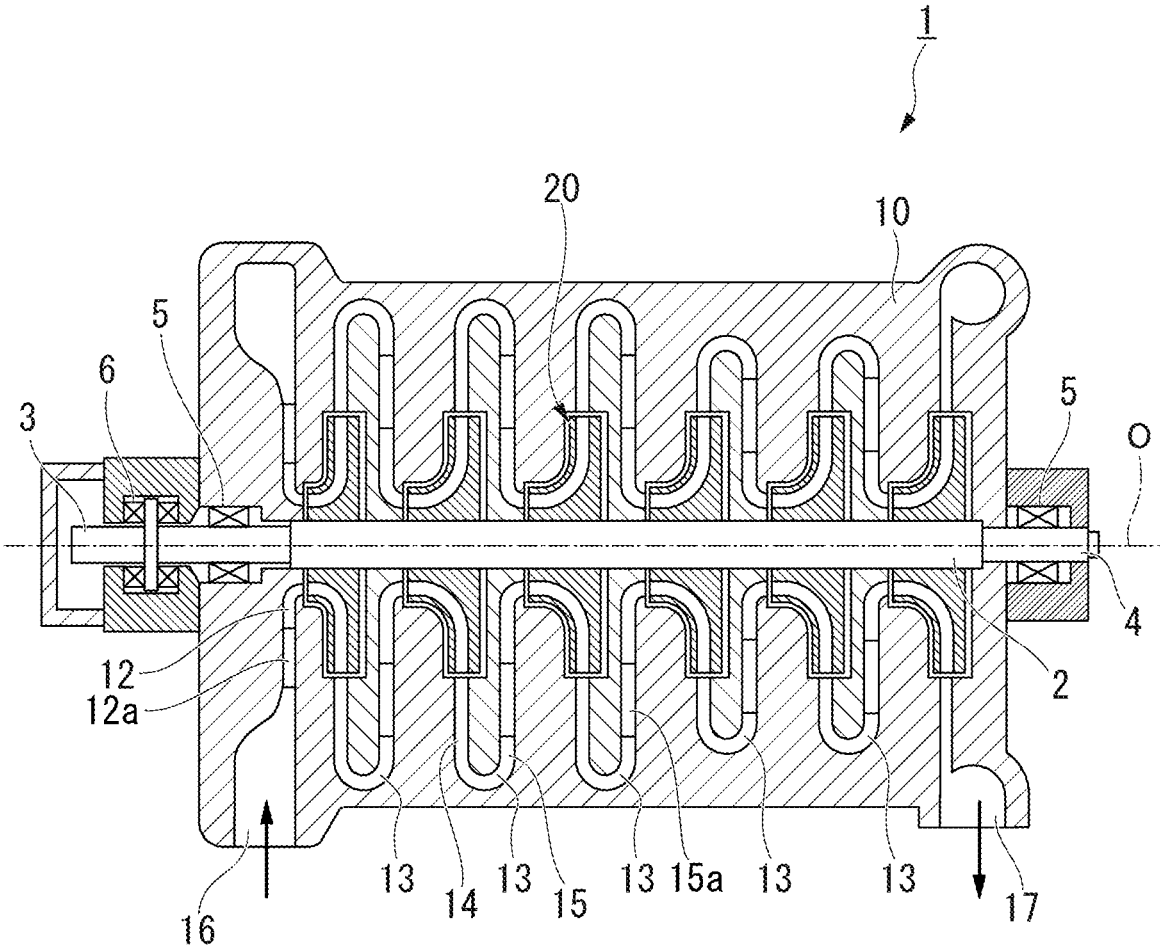
FIG. 1 is a cross-sectional view showing a configuration of a centrifugal compressor according to an embodiment of the present disclosure.

Hereinafter, a centrifugal compressor 1 according to an embodiment of the present disclosure will be described with reference to FIGS. 1 to 4. As shown in FIG. 1, the centrifugal compressor 1 includes a rotating shaft 2 which is allowed to rotate around an axis O, a casing 10 which forms a fluid flow path 9 by covering the rotating shaft 2 from the outside, and a plurality of impellers 20 which are provided in the rotating shaft 2.

The rotating shaft 2 has a columnar shape centered on the axis O. A journal bearing 5 and a thrust bearing 6 are attached to a shaft end 3 on one side of the rotating shaft 2 in the direction of the axis O. Only the journal bearing 5 is provided at a shaft end 4 on the other side of the rotating shaft 2 in the direction of the axis O. The journal bearing 5 supports a load in the radial direction of the rotating shaft 2. The thrust bearing 6 supports a load in the direction of the axis O of the rotating shaft 2.

The casing 10 has a cylindrical shape centered on the axis O. The rotating shaft 2 penetrates the inside of the casing 10 along the axis O. An intake flow path 16 which guides a fluid from the outside toward the impeller 20 is formed on one side of the casing 10 in the direction of the axis O. Further, an exhaust flow path 17 which discharges a high-pressure fluid compressed inside the casing 10 to the outside is formed on the other side of the casing 10 in the direction of the axis O.

An inner space which communicates the intake flow path 16 and the exhaust flow path 17 with each other and repeats an increase in diameter and a decrease in diameter is formed inside the casing 10. This inner space accommodates the plurality of impellers 20 and constitutes a part of the fluid flow path 9. Additionally, in the description below, the location side of the intake flow path 16 on the fluid flow path 9 is referred to as an upstream side and the location side of the exhaust flow path 17 thereon is referred to as a downstream side.

Figure 2:
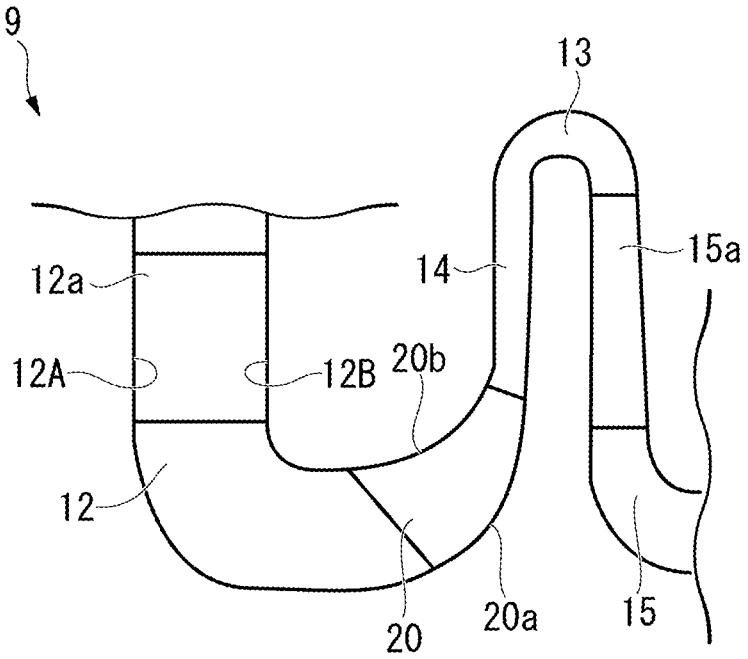
FIG. 2 is a schematic view showing a configuration of a fluid flow path according to the embodiment of the present disclosure.

As shown in FIG. 2, the fluid flow path 9 includes a guide flow path 12, a diffuser flow path 14, a return bent portion 13, and a return flow path 15. The guide flow path 12 is a flow path which guides a fluid led from the intake flow path 16 toward the inside in the radial direction. A plurality of guide vanes 12*a* are provided inside the guide flow path 12. The configuration of the guide vane 12*a* will be described later. The diffuser flow path 14 is a portion which extends radially outward from the impeller 20. The return bent portion 13 is a portion which is turned by 180° from the radial outer end portion of the diffuser flow path 14 and is directed radially inward. The return flow path 15 is connected to the downstream side of the return bent portion 13.

The return flow path 15 extends in the radial direction. Additionally, a return vane 15*a* is provided in the return flow path 15. A plurality of the return vanes 15*a* are arranged at intervals in the circumferential direction.

Configuration of Guide Vane

Here, a radial inner end edge of a blade of the impeller 20 in FIG. 2 is referred to as a hub side end edge 20*a* and the radial outer end edge thereof is referred to as a shroud side end edge 20*b*. A hub side wall surface 12A continuing to the hub side end edge 20*a* and a shroud side wall surface 12B continuing to the shroud side end edge 20*b* are formed in the guide flow path 12 provided on the upstream side of the impeller 20. Each of the guide vanes 12*a* has a plate shape which extends in a direction from the hub side wall surface 12A toward the shroud side wall surface 12B.

Figure 3:
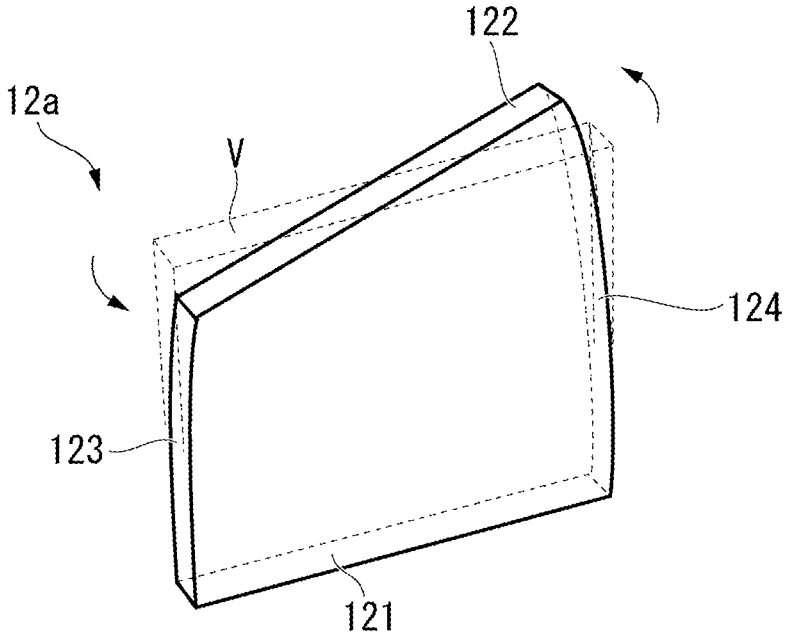
FIG. 3 is a perspective view showing a configuration of a guide vane according to the embodiment of the present disclosure.
Figure 4:
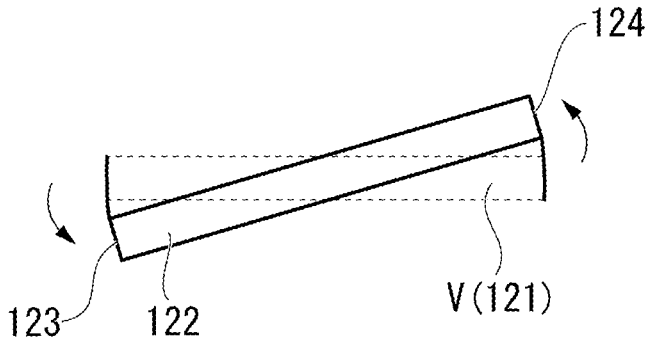
FIG. 4 is a view of the guide vane according to the embodiment of the present disclosure as viewed from the axial direction.

Further, as shown in FIG. 3, the guide vane 12*a* includes a hub side end surface 121 which is connected to the hub side wall surface 12A, a shroud side end surface 122 which is connected to the shroud side wall surface 12B, a leading edge 123 which is directed toward the upstream side of the guide flow path 12, and a trailing edge 124 which is directed toward the downstream side thereof The hub side end surface 121 has an airfoil cross-sectional shape. Additionally, in FIGS. 3 and 4, the shape of the hub side end surface 121 is drawn as a rectangular shape for the sake of simplification. The guide vane 12*a* is gradually twisted forward the impeller 20 in the rotating direction of the impeller 20 as close to the shroud side end surface 122 from the hub side end surface 121. That is, in a virtual cross-section V shown in FIGS. 3 and 4, the shroud side end surface 122 is twisted around a center of gravity thereof. Additionally, the virtual cross-section V mentioned herein indicates a reference shape when the shroud side end surface 122 is formed in the same posture as the hub side end surface 121.

Operation and Effect

Next, the operation of the centrifugal compressor 1 will be described. When operating the centrifugal compressor 1, first, the rotating shaft 2 is rotated around the axis O by a drive source such as an electric motor. The plurality of impellers 20 also rotate together in accordance with the rotation of the rotating shaft 2. As the impeller 20 rotates, a fluid is taken in from the guide flow path 12 to the fluid flow path 9. The impeller 20 applies a centrifugal force to the fluid while the fluid flows through the fluid flow path 9 from the upstream side toward the downstream side, so that the pressure gradually increases. The fluid having a desired pressure is taken out from the exhaust flow path 17 and discharged to the outside.

Incidentally, in recent years, the number of rotations of the impeller 20 has been increasing. Therefore, the relative inflow velocity of the fluid with respect to the impeller 20 has tended to increase. When the relative inflow velocity increases, a shock wave is likely to be generated between the blades of the impeller 20 and the choke limit flow rate becomes low (the operating range of the centrifugal compressor 1 becomes narrow). Here, in this embodiment, the guide vane 12*a* is formed to be twisted as described above.

Figure 5:
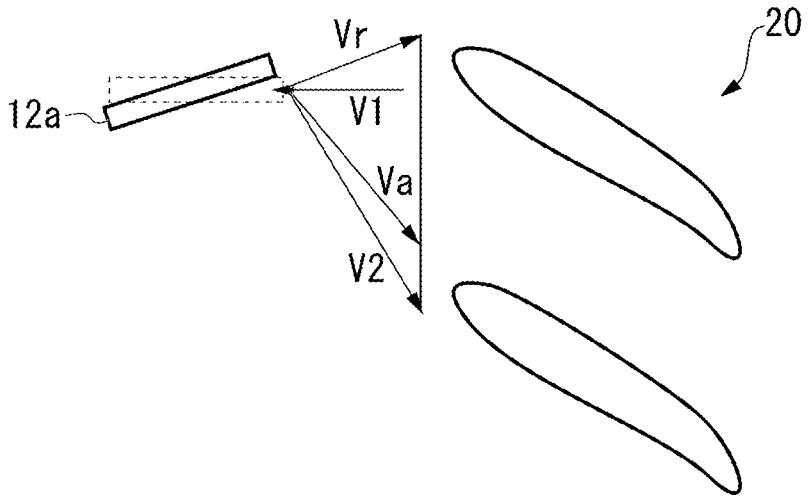
FIG. 5 is an explanatory diagram showing an inflow velocity of a fluid from the guide vane to an impeller according to the embodiment of the present disclosure.

According to the above-described configuration, since the shroud side end surface 122 of the guide vane 12*a* is twisted forward the impeller 20 in the rotating direction thereof, a swirling component is added to the flow flowing into the impeller 20. As shown in FIG. 5, since a swirling component Vr is included, a relative inflow velocity Va of the fluid with respect to the impeller 20 is decreased. Additionally, in the same drawing, V1 indicates a fluid flow component when the guide vane 12*a* is not twisted and V2 indicates a relative inflow velocity in that case. As a result, the probability that the choke is generated in the impeller 20 is reduced and the operating range of the centrifugal compressor 1 can be expanded.

Further, in the guide vane 12*a*, whole of the shroud side end portion (the shroud side end surface 122) is twisted forward the impeller 20 in the rotating direction.

According to the above-described configuration, since the whole of the shroud side end portion (the shroud side end surface 122) of the guide vane 12*a* is twisted as mentioned above, it is possible to more stably add a swirling component to the flow of the fluid. Accordingly, it is possible to further expand the operating range of the centrifugal compressor 1.

Figure 6:
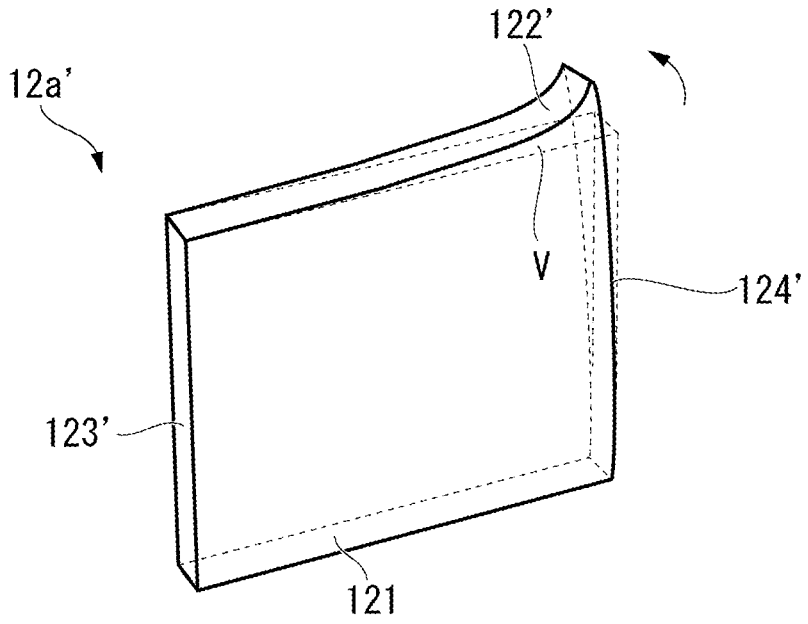
FIG. 6 is a perspective view showing a first modified example of the guide vane according to the embodiment of the present disclosure.

As described above, the embodiment of the present disclosure has been described. Additionally, it is possible to make various changes and modifications to the above configuration as long as it does not deviate from the gist of the present disclosure. For example, as a first modified example shown in FIG. 6, it is also possible to employ a configuration in which only a part which is located at a downstream side of a shroud side end surface 122' (i.e., close to a side of a trailing edge 124') is twisted forward the impeller 20 in the rotating direction. That is, in this configuration, the shroud side end surface 122' is curved at an area from an intermediate position between a leading edge 123' and a trailing edge 124' to a rear side of the vane.

According to the above-described configuration, since only the part which is located at the downstream side of the shroud side end portion of the guide vane 12*a'* is twisted as mentioned above, it is possible to reduce the probability that the flow is separated at the intermediate extension position of the guide vane 12*a'* when adding the swirling component. As a result, it is possible to more stably drive the centrifugal compressor 1.

Figure 7:
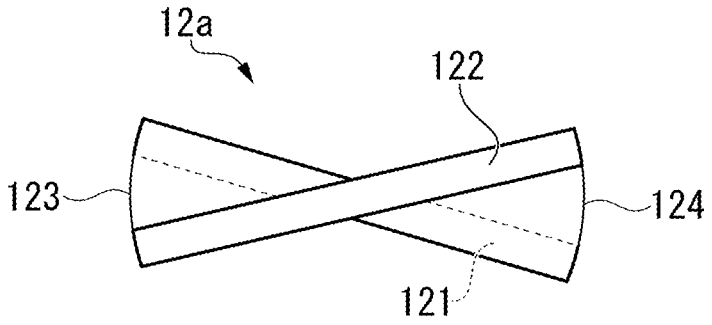
FIG. 7 is a perspective view showing a second modified example of the guide vane according to the embodiment of the present disclosure.
Figure 8:
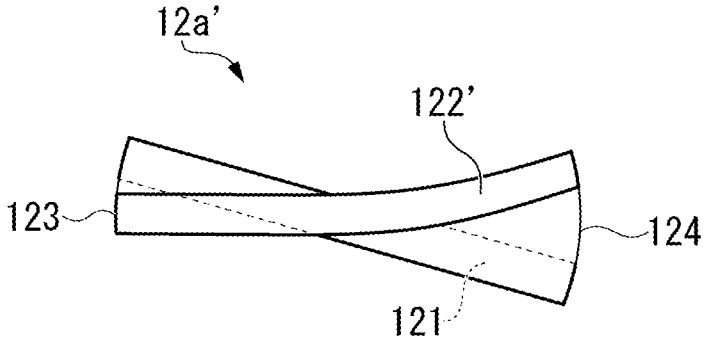
FIG. 8 is a perspective view showing a third modified example of the guide vane according to the embodiment of the present disclosure.

Further, as second and third modified examples shown in FIG. 7 and FIG. 8, it is also possible to employ a configuration in which whole of the hub side end surface 121 is twisted backward the impeller 20 in the rotating direction in addition to the shroud side end surface 122 (122').

According to the above-described configuration, since the hub side end surface 121 is twisted backward the impeller 20 in the rotating direction, the flow velocity of the fluid in the hub side can be increased compared to that of the fluid the shroud side. That is, the decrease in the relative inflow velocity due to the addition of the swirling component toward the front side of the impeller 20 in the rotation direction on the shroud side can be compensated for on the hub side. Accordingly, it is possible to further expand the operating range of the centrifugal compressor 1.

Further, it is also possible to apply the configuration of the guide vanes 12*a* and 12*a'* to each return vane 15*a*.

APPENDIX

The centrifugal compressor 1 of each embodiment is understood, for example, as below.

(1) A centrifugal compressor 1 according to a first aspect includes: the impeller 20 which is allowed to rotate around the axis O; the casing 10 in which the impeller 20 is accommodated and the guide flow path 12 guiding fluid to the impeller 20 is formed; and the guide vane 12*a* which is disposed in the guide flow path 12 and is extended from the hub side wall surface 12A of the guide flow path 12, which is continued to the hub side of the impeller 20, to the shroud side wall surface 12B of the guide flow path 12, which is continued to the shroud side of the impeller 20, wherein the guide vane 12*a* is twisted forward the impeller 20 in the rotating direction thereof as close to the shroud side wall surface 12B from the hub side wall surface 12A.

According to the above-described configuration, since the guide 12*a* is twisted forward the impeller 20 in the rotating direction thereof, a swirling component is added to the flow flowing into the impeller 20. The swirling component makes the relative inflow velocity of the fluid with respect to the impeller 20 is decreased. As a result, the probability that the choke is generated in the impeller 20 is reduced and the operating range of the centrifugal compressor 1 can be expanded.

(2) In the centrifugal compressor 1 according to a second aspect, the guide vane 12*a* may be formed so that whole of the shroud side end portion of the guide vane 12*a* is twisted forward the impeller 20 in the rotating direction.

According to the above-described configuration, since the whole of the shroud side end portion of the guide vane 12*a* is twisted as mentioned above, it is possible to more stably add a swirling component to the flow of the fluid.

(3) In the centrifugal compressor 1 according to a third aspect, the guide vane 12*a*' may be formed so that only the part of the shroud side end portion of the guide vane 12*a*', which is located at a downstream side, is twisted forward the impeller 20 in the rotating direction.

According to the above-described configuration, since only the part of the shroud side end portion of the guide vane 12*a*' is twisted as mentioned above, it is possible to reduce the probability that the flow is separated at the intermediate extension position of the guide vane 12*a*' when adding the swirling component.

(4) In the centrifugal compressor 1 according to a fourth aspect, the guide vane 12*a* (12*a*') may formed so that whole of the hub side end portion of the guide vane 12*a* (12*a*') is twisted backward the impeller 20 in the rotating direction.

According to the above-described configuration, since the whole of the hub side end portion of the guide vane 12 is twisted backward the impeller 20 in the rotating direction, the flow velocity of the fluid on the hub side can be increased compared to that of the fluid on the shroud side. That is, the decrease in the relative inflow velocity due to the addition of the swirling component toward the front side of the impeller in the rotation direction on the shroud side can be compensated for on the hub side.

EXPLANATION OF REFERENCES

1 Centrifugal compressor
2 Rotating shaft
3, 4 Shaft end
5 Journal bearing
6 Thrust bearing
9 Fluid flow path
10 Casing
12 Guide flow path
12*a*, 12*a*' Guide vane
12A Hub side wall surface
12B Shroud side wall surface
13 Return bent portion
14 Diffuser flow path
15 Return flow path
15*a* Return vane
17 Exhaust flow path
20 Impeller
20*a* Hub side end edge
20*b* Shroud side end edge
121 Hub side end surface
122 Shroud side end surface
123 Leading edge
124 Trailing edge
O Axis
V Virtual cross-section

What is claimed is:

1. A centrifugal compressor comprising:
an impeller that is rotatable around an axis;
a casing that:
accommodates the impeller and
comprises a guide flow path that guides fluid to the impeller; and
a guide vane disposed in the guide flow path and that extends from a hub side wall surface of the guide flow path continuous to a hub side of the impeller to a shroud side wall surface of the guide flow path continuous to a shroud side of the impeller, wherein
at least a part of the guide vane at the shroud side wall surface is twisted toward an advancing direction of the impeller relative to the guide vane at the hub side wall surface.

2. The centrifugal compressor according to claim 1, wherein an entirety of the guide vane at the shroud side wall surface is twisted toward the advancing direction of the impeller relative to the guide vane at the hub side wall surface.

3. The centrifugal compressor according to claim 1, wherein only a downstream part of the guide vane at the shroud side wall surface is twisted toward the advancing direction of the impeller relative to the guide vane at the hub side wall surface.

4. The centrifugal compressor according to claim 1, wherein an upstream edge of the guide vane at the hub side wall surface is disposed in an opposite direction to the advancing direction of the impeller relative to a downstream edge of the guide vane at the hub side wall surface.

5. The centrifugal compressor according to claim 2, wherein an upstream edge of the guide vane at the hub side wall surface is disposed in an opposite direction to the advancing direction of the impeller relative to a downstream edge of the guide vane at the hub side wall surface.

6. The centrifugal compressor according to claim 3, wherein an upstream edge of the guide vane at the hub side wall surface is disposed in an opposite direction to the advancing direction of the impeller relative to a downstream edge of the guide vane at the hub side wall surface.

* * * * *